United States Patent [19]

Kruske

[11] 4,188,209

[45] Feb. 12, 1980

[54] NICKEL-BASE ALLOY

[75] Inventor: Gerhard Kruske, Oberursel, Fed. Rep. of Germany

[73] Assignee: Metallgesellschaft Aktiengesellschaft, Frankfurt, Fed. Rep. of Germany

[21] Appl. No.: 828,718

[22] Filed: Aug. 29, 1977

[30] Foreign Application Priority Data

Sep. 1, 1976 [DE] Fed. Rep. of Germany ..... 2639325

[51] Int. Cl.[2] ..... C22C 19/05

[52] U.S. Cl. ..... 75/122; 75/134 F; 75/171; 75/176; 148/32

[58] Field of Search ..... 75/171, 170, 176, 122, 75/134 F; 148/32, 32.5

[56] References Cited

U.S. PATENT DOCUMENTS 2,744,009 5/1956 Bowne et al. ..... 75/171

*Primary Examiner*—R. Dean

*Attorney, Agent, or Firm*—Sprung, Felfe, Horn, Lynch & Kramer

[57] ABSTRACT

The invention relates to the provision of nickel-base alloys which contain carbon, tungsten, chromium, boron, silicon, and iron. The alloys are resistent to corrosion, abrasion, erosion, cavitation and to temperature cycles and possess high high-temperature strength. They find utility particularly in thermal and nuclear power plants.

8 Claims, 1 Drawing Figure

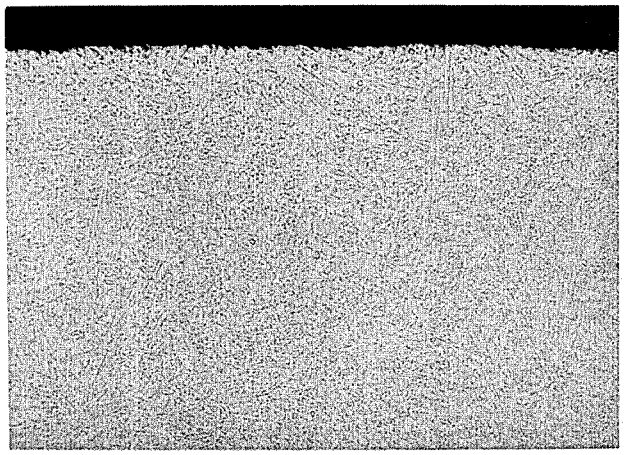

NICKEL-BASE ALLOY

This invention relates to a nickel-base alloy which is resistant to corrosion, abrasion, erosion, cavitation and to temperature cycles and possesses a high high-temperature strength.

Practice in thermal and nuclear power plants has shown that fittings are most likely to be damaged at their sealing surfaces. Such damage may be due to intergranular corrosion, erosion, abrasion, cavitation and/or to temperature cycles. The coating of the sealing surfaces of fittings with alloys by weld-surfacing has proved to be a reliable method of increasing the stability of these surfaces.

The metal which has been applied to the sealing surfaces by weld-surfacing, resist a unit pressure up to 10,000 N/cm$^2$ and temperature cycles up to a temperature difference of 600° C. Its Rockwell C hardness number should be 35 to 40, as a rule. Besides, structure and properties of the metal should be stable for a relatively long time and the metal should have a good workability and is required to be produced by simple technology.

Cobalt-chromium alloys are best known as coating materials to be applied to sealing surfaces by weld-surfacing. They are distinguished by a high resistance to corrosion and erosion and have a high high-temperature strength up to 640° C. and also a high wear resistance. Their hardness decreases rapidly above 650° C. Other disadvantages reside in the high working costs and in the presence of cobalt, which results in the formation of $Co^{60}$, which is a long-lived radioactive isotope. Besides, weld-surfacing requires preheating to a relatively high temperature, which must be maintained during the weld-surfacing. The material which has been applied is annealed and is subsequently subjected to a retarded cooling.

For these reasons, nickel-chromium-boron-silicon alloys have been used more recently. The advantages of these alloys reside in their relatively low melting point, lower manufacturing costs and a much lower preheating temperature for weld-surfacing.

On the other hand, the nickel-chromium-boron-silicon alloys known from published German specifications Nos. 11 98 169 and 15 58 880 and French Pat. No. 1,376,914 are not satisfactory as regards resistance to corrosion, particularly intergranular corrosion, as well as regards high-temperature hardness and susceptibility to cracking.

It has been stated in published German specification No. 24 46 517 that this behavior is due to the fact that said alloys have a high carbon content, which results in the formation of carbides. For this reason, the last-mentioned published German specification discloses a nickel-chromium-boron-silicon alloy which is virtually free from carbon and should contain the same only as an impurity up to 0.05%. It is hardly believable that such very low carbon content can be controlled during the production of the alloy because practice has shown that carbon is introduced together with all other components. For this reasons, the carbon content will always exceed 0.05% and these alloys in the compositions used in practice and described in the examples contain copper, which is used to oppose intergranular corrosion. On the other hand, the presence of copper decreases the weldability of the alloy.

It is an object of the invention to provide a nickel-base alloy which essentially contains carbon in order to permit a formation of carbides and which has a composition such that intergranular corrosion, erosion, abrasion, cavitation and thermal fatigue are avoided and a hardness of at least 35 on the Rockwell C scale is achieved. For extremely high stresses, the alloy should have a hardness up to 60 on the Rockwell C scale.

This object is accomplished by the provision of a nickel-base alloy having the following compostion in % by weight:

Carbon: 0.5 to 5
Tungsten: 2 to 15
Chromium: 25 to 55
Boron: 0.5 to 3.5
Silicon: 1 to 5
Iron: 1 to 5
Nickel: balance in which (a) % by weight C = % by weight $C_1$ + % by weight $C_2$ + 0.2;
(b) % by weight W = 36 × % by weight $C_1$; and
(c) % by weight Cr ≧ 17 + 9 × % by weight $C_2$ = 4 × % by weight C Preferably, % by weight Cr ≧ 25 + 9 × % by weight $C_2$ − 4 × % by weight C.
% by weight $C_1$ = carbon content required to form carbides with refractory metals (tungsten, molybdenum)
% by weight $C_2$ = carbon content required to form chromium carbide
0.2 = a constant which is equivalent to the solubility limit of C in the nickel-chromium solid solution.

In a preferred embodiment, the nickel-base alloy has the following composition in % by weight:

Carbon: 0.5 to 3
Tungsten: 7 to 10
Chromium: 30 to 40
Boron: 0.5 to 1.5
Silicon: 1 to 3
Iron: 2 to 3
Nickel: balance Tungsten may be replaced entirely or in part by molybdenum, provided that % by weight Mo = 18 × % by weight $C_1$.

The alloy may contain cobalt as an impurity up to the limit which causes the formation of the undesired $Co^{60}$.

The invention will now be explained with reference to an example:

An alloy powder having the following preferred composition in % by weight: Carbon 1.2; chromium 31.5; silicon 2.0; boron 0.6; tungsten 7.8; iron 2.0; balance nickel; was applied by weld-surfacing in a plasma welding plant to a valve gate for use in a nuclear power plant.

The weld-surfaced coating was initially subjected to the "Strauss Test" in accordance with Stahl-Eisen Prüfblatt 1975 in order to test its resistance to intergranular corrosion. The testing time in the boiling solution amounted to 15 hours. After the test, a polished section of the valve gate was subjected to metallographic examination which showed that there had been no intergranular attack on the surface of the applied layer nor at the junction between said layer and the base metal. This is apparent from the illustration in the drawing.

An additional test in accordance with MW-Prüfblatt E2 of Mannesmann-Werke was conducted in a boiling solution of $H_2SO_4+Fe_2(SO_4)_3\times XH_2O$ for 8 hours. In that case, no intergranular attack was observed too.

Owing to their specific effects, these tests are intended only for wrought alloys and their significance as applied to cast alloys might be doubted. For this reason the valve gate was additionally exposed to the extremely aggressive fluids which contact the fittings during the decontamination and consist mainly of oxalic acid and mixed nitric and oxalic acids. In that case too, the examination of a polished section showed that there had been no intergranular corrosion and no area corrosion of metal.

To test its resistance to temperature cycles, the coated valve gate was subjected to cycles consisting of heating in a furnace to about 400° C. and quenching in water. Because the tests have only a characterizing significance, they were discontinuted after 100 temperature changes. After that time, neither cracks nor other damage which could have been caused by thermal fatigue were found.

To test its resistance to pickling, the alloy was exposed under operating conditions to a pickling solution which was to be used in operation and was composed of 25% nitric acid of 62% concentration; 7% hydrofluoric acid of 40% concentration, balance water, at 20° C. for 0.5 hour. The alloy was also exposed to a pickling solution having the same composition for 24 hours. The examination of polished sections revealed no area corrosion.

The measured hardness at room temperature amounted to 37 on the Rockwell C scale.

The wear of the valve gate was visually inspected after 10,000 opening and closing movements. A formation of scores was not observed.

A powder of the alloy according to the invention is particularly suitable for plasma welding and plasma spraying as well as for flame spraying and shock spraying, for gas-powder weld-surfacing and for spray welding. The powder is also used to make filler wire. Rods made of the alloy are used particularly in inert gas welding and oxyacetylene welding. The alloy according to the invention is used also in the manufacture of electrodes having alloy core rods and/or alloy sheaths. Strip for submereged arc welding and for spin-welding can also be made from the alloy. The alloy may be used to make sheet metal elements, which are applied to a base member that is to be protected.

Owing to its excellent technological properties, the material according to the invention may be cast in the manufacture of shaped members for use as machine elements which are expected to be subjected to corrosive, abrasive, erosive and/or cavitational influences. The alloy can also be applied to screws for separators, screws for extruders, or the like.

It will be appreciated that the instant specification and examples are set forth by way of illustration and not limitation, and that various modifications and changes may be made without departing from the spirit and scope of the present invention.

What is claimed is:

1. A nickel-base alloy which is resistant to corrosion, abrasion, erosion, cavitation and to temperature cycles and possesses a high high-temperature strenght, consisting essentially of the following composition in % by weight:

Carbon: 0.5 to 5
Tungsten: 7 to 15
Chromium: 25 to 55
Boron: 0.5 to 3.5
Silicon: 1 to 5
Iron: 1 to 5
Nickel: balance and (a) % by weight $C=$% by weight $C_1+$% by weight $C_2+0.2$;
(b) % by weight $W=36\times$% by weight $C_1$; and
(c) % by weight $Cr\geqq 17+9\times$% by weight $C_2-4\times$% by weight C, % by weight $C_1$ being the carbon content required to form carbide refractory materials and % by weight $C_2$ being carbon content required to form chromium carbide.

2. A nickel-base alloy according to claim 1, wherein % by weight $Cr\geqq 25+9\times$% by weight $C_2-4\times$% by weight C.

3. A nickel-base alloy according to claim 1, having the following composition in % by weight:

Carbon: 0.5 to 3
Tungsten: 7 to 10
Chromium: 30 to 40
Boron: 0.5 to 1.5 Silicon: 1 to 3
Iron: 2 to 3
Nickel: balance.

4. A nickel base alloy according to claim 2, having the following composition in % by weight:

Carbon: 0.5 to 3
Tungsten: 7 to 10
Chromium: 30 to 40
Boron: 0.5 to 1.5
Silicon: 1 to 3
Iron: 2 to 3
Nickel: balance.

5. A nickel-base alloy according to claim 1, having the following composition in % by weight:

Carbon: 1.2
Chromium: 31.5
Silicon: 2.0
Boron: 0.6
Tungsten: 7.8
Iron: 2.0
Nickel: balance.

6. A nickel-base alloy according to claim 2, having the following composition in % by weight:

Carbon: 1.2
Chromium: 31.5
Silicon: 2.0
Boron: 0.6
Tungsten: 7.8
Iron: 2.0
Nickel: balance.

7. A nickel-base alloy according to claim 1, characterized in that tungsten is replaced entirely or in part by molybdenum and % by weight $Mo=18\times$% by weight $C_1$.

8. A nickel-base alloy according to claim 2, characterized in that tungsten is replaced entirely or in part by molybdenum and % by weight Mo=18% by weight $C_1$.

* * * * *